US007931170B2

(12) United States Patent
Che

(10) Patent No.: US 7,931,170 B2
(45) Date of Patent: Apr. 26, 2011

(54) PET WASTE BAG DISPENSER

(76) Inventor: Peter H. Che, El Monte, CA (US)

( * ) Notice: Subject to any disclaimer, the term of this patent is extended or adjusted under 35 U.S.C. 154(b) by 0 days.

(21) Appl. No.: 11/403,295

(22) Filed: Apr. 12, 2006

(65) Prior Publication Data

US 2007/0241123 A1 Oct. 18, 2007

(51) Int. Cl.
*B65D 83/00* (2006.01)
*A01K 1/064* (2006.01)

(52) U.S. Cl. ..... 221/64; 221/281; 221/61; 221/62; 221/33; 294/1.3; 206/390; 206/293; 206/233

(58) Field of Classification Search ..... 221/1–312 C; 294/1.3; 206/390, 293, 233; 150/144
See application file for complete search history.

(56) References Cited

U.S. PATENT DOCUMENTS 1,648,565 A * 11/1927 Primley ..... 206/315.9
4,192,365 A * 3/1980 Siegel ..... 150/111
4,250,938 A * 2/1981 Siegel ..... 150/111
4,350,274 A * 9/1982 Morgan ..... 224/610
4,421,150 A * 12/1983 Masters ..... 383/61.1
4,566,607 A * 1/1986 Smith ..... 229/242
4,677,697 A * 7/1987 Hayes ..... 2/159
4,739,809 A * 4/1988 Adams ..... 150/112
4,893,739 A * 1/1990 Conner ..... 224/240
4,988,216 A * 1/1991 Lyman ..... 383/74
5,127,545 A * 7/1992 French ..... 221/102
5,292,042 A * 3/1994 Yamaguchi et al. ..... 224/159
5,447,227 A * 9/1995 Kosberg ..... 206/233
5,560,321 A * 10/1996 Hess ..... 119/858
5,718,192 A * 2/1998 Sebastian ..... 119/795
6,085,695 A * 7/2000 Miller et al. ..... 119/795
6,257,473 B1 * 7/2001 Ringelstetter ..... 224/675
D453,067 S * 1/2002 Cody ..... D3/215
6,427,839 B1 * 8/2002 Helfer-Grand ..... 206/494
6,578,730 B2 * 6/2003 Trunsky ..... 221/34
6,926,149 B2 * 8/2005 Tippey ..... 206/494
7,073,462 B1 * 7/2006 Layman ..... 119/161
7,300,395 B2 * 11/2007 Sleight et al. ..... 493/215
7,367,286 B2 * 5/2008 Beaupre ..... 119/795
D576,433 S * 9/2008 Che ..... D6/518
2005/0263087 A1 * 12/2005 Livingston ..... 119/161

* cited by examiner

*Primary Examiner* — Gene Crawford
*Assistant Examiner* — Michael K Collins
(74) *Attorney, Agent, or Firm* — Raymond Y. Chan; David and Raymond Patent Firm

(57) ABSTRACT

A pet waste bags dispenser includes a pouch body, a pouch cover, means for detachably attaching the front cover edge of the pouch cover on the front wall of the pouch body, and a bag dispenser, wherein the bag dispenser allows waste bags placed within the waste bags dispenser to be dispensed to a user easily and conveniently. The pet waste bags dispenser is made of a collapsible material, such that the dispenser is easy to store, light in weight, simple to manufacture, and has the flexibility to contain different amounts of waste bags within the pouch body, wherein rolls of or individually wrapped waste bags are allowed to be dispensed. The pet waste bags dispenser further includes a pouch carrier for the pouch body to be carried around, so as to facilitate the user to easily obtain a waste bag from the dispenser.

4 Claims, 2 Drawing Sheets

PET WASTE BAG DISPENSER

BACKGROUND OF THE PRESENT INVENTION

1. Field of Invention

The present invention relates to a bag dispenser, and more particularly to a dispenser for pet waste bags, which comprises a pouch structure for storing the pet waste bags, such that the pet waste bags can be dispensed conveniently. The pet waste bag dispenser is constructed easy to carry around, easy to store, light in weight, easy to manufacture, and in a low manufacturing cost.

2. Description of Related Arts

People in the developed world are known to be very conscious about health and environment, which makes pet owners very careful about not leaving behind pet wastes when walking their pets. In fact, many developed countries have rules and regulations regarding pet wastes. Pet owners can receive citations when they get caught for not cleaning up after the pets.

Due to an advance in technology, as well as wealth, cleaning up pet wastes has advanced from using magazine pages, newspaper and plastic shopping bags which are really inconvenience to using specifically produced for picking up pet wastes. Plastic bags designed for pet wastes are already available in the market and generally enclosed within dispensers. Such dispenser is simply another bigger plastic bag or bulk container substantially making a pet owner carrying around difficult while walking his or her pet. It is also difficult to dispense the pet waste bags for use.

SUMMARY OF THE PRESENT INVENTION

A main object of the present invention is to provide a pet waste bag dispenser which is easy to store, carry and use with cheaper manufacturing cost. The pet waste bag dispenser for dispensing pet waste bags of the present invention comprises a pouch body having a bag cavity provided for pet waste bags disposed therein, a pouch cover provided for covering an opening of the bag cavity preventing the pet waste bags from falling off the pet waste bag dispenser, means for detachably attaching the front cover edge of the pouch cover on the front wall of the pouch body, and a bag dispenser such that the pet waste bags are dispensed without the pouch cover being lifted up.

Another object of the present invention is to provide a pet waste bag dispenser, wherein the bag dispenser is provided on a front wall of the pouch body, such that the pet waste bags are dispensed with or without the pouch cover being closed.

Another object of the present invention is to provide a pet waste bag dispenser, further has a pouch carrier for easy carrying around and accessing of the pet waste bags in the pet waste bag dispenser.

Another object of the present invention is to provide a pet waste bag dispenser, wherein the pouch carrier forms a detachable loop for looping the pet waste bag dispenser onto a desired object.

Another object of the present invention is to provide a pet waste bag dispenser, wherein the pouch body has an elastic element for the pouch body to accommodate any amount of waste bags being placed within the dispenser cavity, wherein the pouch body will expand slightly when more waste bags are placed within the dispenser cavity, and will bind the pet waste bags even when there are a few waste bags placed within the dispenser cavity, such that the pet waste bags will not move around within the waste dispenser cavity.

Another object of the present invention is to provide a pet waste bag dispenser, so as to dispense rolls of waste bags.

Another object of the present invention is to provide a pet waste bag dispenser wherein all elements of the dispenser are undetachably attached together so as to achieve all of the above objectives with no detachable parts, such that the storage and usage of the pet waste bag dispenser are more efficient and effective.

Accordingly, in order to accomplish the above objects, the present invention provides a pet waste bag dispenser, comprising:

a plurality of pet waste bags detachably connected end to end in roll manner;

a pouch body having a front wall, a rear wall and two sidewalls defining a bag cavity to store the roll of pet waste bags therein and a top opening communicating with the bag cavity;

a pouch cover having a front cover edge extended from the rear wall of the pouch body;

an attachment device detachably attaching the front cover edge of the pouch cover on the front wall of the pouch body so as to cover the top opening of the pouch body and enclose the bag cavity to retain the pet waste bags therein; and a bag dispenser, which is provided on the front wall of the pouch body at a position below the front cover edge of the pouch cover when the pouch cover is detachably attached on the front wall, allowing the pet waste bags to be dispensed out of the bag cavity when the bag cavity is enclosed by the pouch cover.

These and other objectives, features, and advantages of the present invention will become apparent from the following detailed description, the accompanying drawings, and the appended claims.

DETAILED DESCRIPTION OF THE PREFERRED EMBODIMENT

Figure 1:
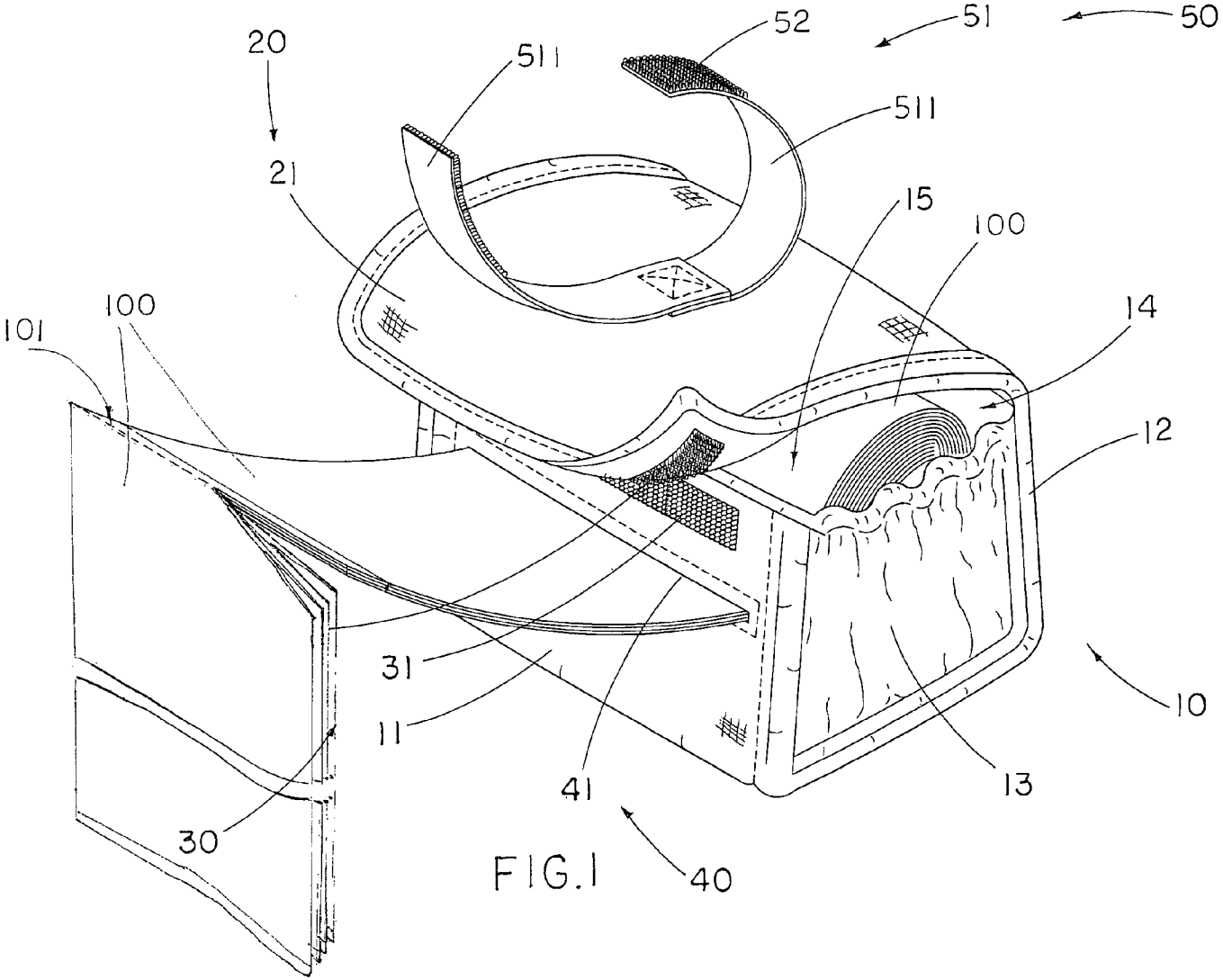
FIG. 1 is a perspective view of the pet waste bag dispenser according to the preferred embodiment of the present invention.
Figure 2:
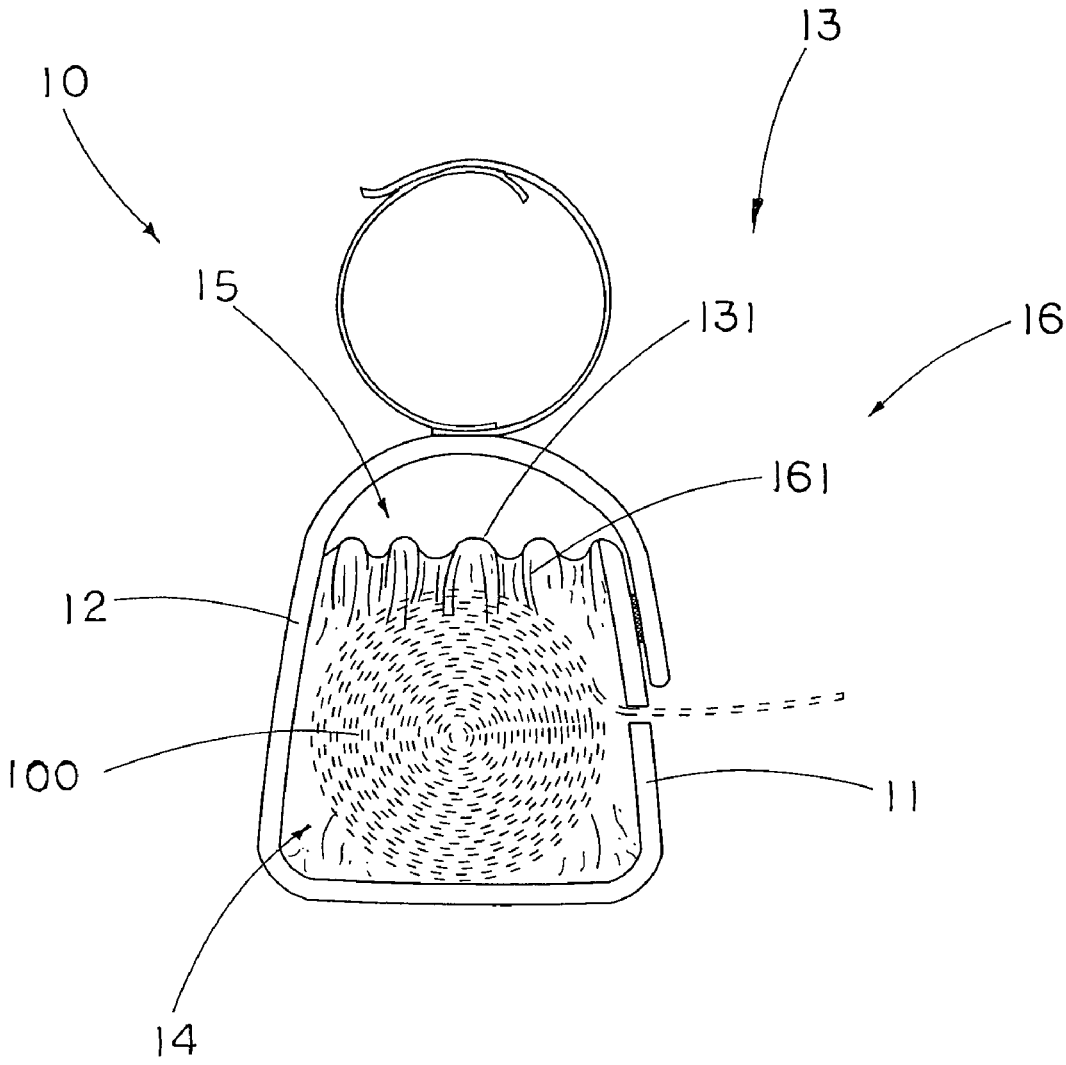
FIG. 2 is a cross-sectional view of the pet waste bag dispenser according to the above preferred embodiment of the present invention.

Referring to FIGS. 1 and 2 of the drawings, a pet waste bag dispenser according to a preferred embodiment of the present invention is illustrated, wherein the pet waste bag dispenser comprises a plurality of plastic made pet waste bags 100, a pouch body 10, a pouch cover 20, an attachment device 30, and a bag dispenser 40.

The plurality of pet waste bags 100 is detachably connected end to end in roll manner along pre-cut connection lines 101. The pouch body 10 has a front wall 11, a rear wall 12 and two sidewalls 13 defining a bag cavity 14 to store the roll of pet waste bags 100 therein and a top opening 15 communicating with the bag cavity 14, such that the pet waste bags 100 can be refilled into the bag cavity 14 through the top opening 15.

According to the preferred embodiment of the present invention, the pet waste bag dispenser is designed for the roll of rectangular shaped pet waste bags in such a manner that the pet waste bags 100 can easily be dispensed continuously.

The pouch cover 20 is provided for covering the top opening 15 of the bag cavity 14, so as to protect the pet waste bags 100 disposed within the bag cavity 14 through the top opening 15 and to prevent the pet waste bags 100 from falling off the bag cavity 14 or from damages. The pouch cover 20 has a front cover edge 21 extended from the rear wall 11 of the pouch body 10 for detachably attaching the front cover edge 21 of the pouch cover 20 on the front wall 11 of the pouch body 10.

In order to ensure that the top opening 15 is to remain closed, the pet waste bag dispenser comprises the attachment device 30 for detachably attaching the front cover edge 21 of the pouch cover 20 on the front wall 13 of the pouch body 10, wherein the pouch cover 20 is frontwardly folded to cover the top opening 15 of the pouch body 10 so as to enclose the bag cavity 14 and retaining the pet waste bags 100 therein.

It is worth mentioning that, the pouch cover 20 can be an independent piece having one end attached to the rear wall 12 and the other end extending from the rear wall 12 to the front wall 11 or, as shown in FIGS. 1 and 2, can be integrally and frontwardly extended from the rear wall 12 to the front wall 11 while covering the opening 15 while reducing the number of manufacturing procedures and material to be used. Also, the attachment device 30 ensures that the pouch cover 20 will not accidentally open up and let the pet waste bags 5 to spill out of the bag cavity 14.

According to the preferred embodiment of the present invention, the attachment device 30 comprises a first fastener 31 and a second fastener 32. The first fastener 31 is provided on the front wall 11 of the pouch body 10 above the bag dispenser 40. The second fastener 32, which is provided on an inner side of the front cover edge 21 of the pouch cover 20, is arranged to detachably fasten with the first fastener 31 such that the pouch cover 20 is retained in a closed position. Of course, the attachment device 30 can be other connectors too, including button snap, button and hole, and other detachable adhesive means.

It should be noted that, according to the preferred embodiment of the present invention, the first fasteners 31 and second fasteners 32 are a pair of hook and loop fasteners respectively.

The bag dispenser 40 is provided for the pet waste bags 5 inside the bag cavity 14 to be dispensed out of the pet waste bag dispenser. According the preferred embodiment of the invention, the bag dispenser 40 is provided on the front wall 11 of the pouch body 10 preferably at a position below the front cover edge 21 of the pouch cover 20 when the pouch cover 20 is detachably attached on the front wall 11.

The bag dispenser 40 is adapted for allowing the pet waste bags 100 to be dispensed out of the bag cavity 14 when the bag cavity 14 is enclosed by the pouch cover 20, such that the pet waste bags 100 can be pulled out of the bag cavity 14 without having to use both hands to hold on to the pet waste bag dispenser or to have to open up the pouch cover 20 to reach the pet waste bags 100 in the bag cavity 14, allowing a user to effortlessly utilize the pet waste bags 100, when he/she might not have both hands free.

According to the preferred embodiment of the present invention, the bag dispenser 40 of the pet waste bag dispenser contains a dispensing slit 41, which is transversely formed in the front wall 11 of the pouch body 10 for the pet waste bag 100 to slide out of the bag cavity 14 through the dispensing slit 41.

It should be noted that the dispensing slit 41 has a width larger than a width of the waste bag 5 in a folded manner while the waste bag is rolled to be stored in the bag cavity 14, or else the pet waste bags 5 may not easily dispensed out of the bag cavity 14.

It is worth mentioning that the pet waste bag dispenser, including the pouch body 10 and the pouch cover 20, is made of a collapsible material, which enables the pet waste bag dispenser, when empty, to be easily folded, occupying less space and effectively stored inside the pocket of the user. It means that when the user stores the pet waste bag dispenser inside his pocket, there will be no bulging, and therefore no one can see it.

The pet waste bag dispenser further comprises a pouch carrier 50 provided for the pet waste bag dispenser to be carried around. The pouch carrier 50 enables the user to link the pet waste bag dispenser to a foreign object which allows the user to easily obtain a pet waste bag 100 from the pet waste bag dispenser without having to hold on to the pet waste bag dispenser.

By allowing the user to obtain a pet waste bag 100 from the pet waste bag dispenser with only one hand, without having to hold on to the pet waste bag dispenser, ensures that the user does not have to loose concentration in watching his or her dog wile obtaining the pet waste bag. Imagine if a user has to hold the pet waste bag dispenser with both hands while trying to hold on to the leash of the dog, him or her may easily loose the leash of the dog and create hazard to both the dog and other pedestrians around.

The pouch carrier 50 comprises a carrier strap 51, which is attached to the pouch cover 20 and a fastener element 52 provided on the carrier strap 51 in such a manner that two free ends 511 of the carrier strap 51 are detachably attached to form a carry loop for the pouch body 10 to be carried.

Referring to FIG. 2 of the drawings, according to the preferred embodiment of the present invention, in order to flexibly and comfortably accommodate different amount of pet waste bags 100 within the bag cavity 14, the pouch body 10 further comprises an elastic element 16, which is provided on the pouch body 10 at the top opening 15. The effect of having the elastic element 16 is to shrink a size of the top opening 15 for securely retaining the waste bag 5 within the bag cavity 14.

Also according to the preferred embodiment of the present invention, the elastic element 16 comprises two elastic bands 161. The elastic bands 161 are provided along top edges 131 of the sidewalls 13 respectively, so as to substantially pull the front wall 11 and the rear wall 12 towards each other so as to form the bag cavity 14 having a trapezoid shape.

Basically, when there are fewer pet waste bags 100 in the pouch body 10, the flexible elastic elements 16 prevent the pet waste bags 100 from falling out off the bag cavity 14 due to the emptiness within the bag cavity 14. And, when there are many pet waste bags 100 in the pouch body 10, the elastic element 16 expands to bind around the pet waste bags 100 within the pouch body 10, such that the pet waste bags 10 will not ooze out of the bag cavity 14 simply because the bag cavity 14 is fuller.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pet waste bag dispenser, comprising:

a plurality of pet waste bags detachably connected end to end in roll manner to form a compact structure;

a pouch body having a front wall, a rear wall and two sidewalls defining a bag cavity to store said pet waste bags therein and a top opening communicating with said bag cavity, wherein said pouch body comprises an elastic element which comprises two elastic bands provided along top edges of said sidewalls respectively at said top opening so as to shrink a size of said top opening of said pouch body for securely retaining said pet waste bags within said bag cavity and to substantially pull said front and rear walls towards each other so as to form said bag cavity having a trapezoid cross section for preventing said pet waste bags in rolled form from being unintentionally moved within said bag cavity;

a pouch cover, having a front cover edge, extended from said rear wall of said pouch body for covering said top opening of said bag cavity, wherein said pouch cover is frontwardly folded to cover said top opening of said pouch body so as to enclose said bag cavity for retaining said pet waste bags therein, wherein said top opening of said pouch body is shrunk for preventing said pet waste bags in rolled form from falling out of said bag cavity when said pouch cover is unfolded to open up said bag cavity;

an attaching means comprising a first fastener provided on said front wall of said pouch body, and a second fastener which is provided on said pouch cover and is arranged to detachably fasten with said first fastener so as to retain said pouch cover in a closed position;

a bag dispenser provided on said front wall of said pouch body at a position below said attaching means of said front cover edge of said pouch cover and said front wall of said pouch body when said pouch cover is detachably attached on said front wall, wherein said bag dispenser is adapted for allowing said pet waste bags to be dispensed out of said bag cavity when said bag cavity is enclosed by said pouch cover, wherein said bag dispenser contains a dispensing slit transversely formed on said front wall of said pouch body in such a manner that said pet waste bag is capable of transversely and downwardly sliding out of said bag cavity through said dispensing slit while said roll of said pet waste bags is rotated within said bag cavity of said pouch body, wherein said dispensing slit has a width larger than a width of each of said pet waste bags in rolled form and stored in said bag cavity; and a pouch carrier for said pouch body to be carried, wherein said pouch carrier comprises a carrier strap attached to said pouch cover and a fastener element provided on said carrier strap in such a manner that two free ends of said carrier strap are detachably attached to form a carrying loop for said pouch body to be carried.

2. The pet waste bag dispenser, as recited in claim 1, wherein said first and second fasteners are a pair of hook and loop fasteners respectively.

3. A pet waste bag dispenser for a plurality of pet waste bags detachably connected end to end in roll manner to form a compact structure, comprising:

a pouch body having a front wall, a rear wall and two sidewalls defining a bag cavity to store said pet waste bags therein and a top opening communicating with said bag cavity, wherein said pouch body comprises an elastic element which comprises two elastic bands provided along top edges of said sidewalls respectively at said top opening so as to shrink a size of said top opening of said pouch body for securely retaining the pet waste bags within said bag cavity and to substantially pull said front and rear walls towards each other so as to form said bag cavity having a trapezoid cross section for preventing said pet waste bags in rolled form from being unintentionally moved within said bag cavity;

a pouch cover, having a front cover edge, extended from said rear wall of said pouch body for covering said top opening of said bag cavity, wherein said pouch is frontwardly folded to cover said top opening of said pouch body so as to enclose said bag cavity for retaining said pet waste bags therein, wherein said top opening of said pouch body is shrunk for preventing said waste bag in rolled form from falling out of said bag cavity when said pouch cover is unfolded to open up said bag cavity;

a first fastener provided on said front wall of said pouch body, and a second fastener which is provided on said pouch cover and is arranged to detachably fasten with said first fastener so as to retain said pouch cover in a closed position;

a bag dispenser provided on said front wall of said pouch body at a position below said attaching means of said front cover edge of said pouch cover and said front wall of said pouch body when said pouch cover is detachably attached on said front wall, wherein said bag dispenser is adapted for allowing the pet waste bags to be dispensed out of said bag cavity when said bag cavity is enclosed by said pouch cover, wherein said bag dispenser contains a dispensing slit transversely formed on said front wall of said pouch body for the pet waste bag to be transversely and downwardly sliding out of said bag cavity through said dispensing slit while the roll of the pet waste bags is rotated within said bag cavity of said pouch body, wherein said dispensing slit has a width larger than a width of each of said pet waste bags in rolled form and stored in said bag cavity; and a pouch carrier for said pouch body to be carried, wherein said pouch carrier comprises a carrier strap attached to said pouch cover and a fastener element provided on said carrier strap in such a manner that two free ends of said carrier strap are detachably attached to form a carrying loop for said pouch body to be carried.

4. The pet waste bag dispenser, as recited in claim 3, wherein said first and second fasteners are a pair of hook and loop fasteners respectively.

* * * * *